United States Patent [19]

Price et al.

[11] Patent Number: 4,549,778

[45] Date of Patent: Oct. 29, 1985

[54] ELECTRICAL SOCKET COVER

[75] Inventors: Fred D. Price, 107 Woodland Forest, Winfield, W. Va. 25213; R. Neal Pierce, Sissonville, W. Va.

[73] Assignee: Fred D. Price, Winfield, W. Va.

[21] Appl. No.: 595,617

[22] Filed: Apr. 2, 1984

[51] Int. Cl.[4] ..... H01R 13/453

[52] U.S. Cl. ..... 339/40; 339/42

[58] Field of Search ..... 339/40, 41, 42

[56] References Cited

U.S. PATENT DOCUMENTS

| | | | |
|---|---|---|---|
| 2,818,991 | 1/1953 | Hess | 220/24.3 |
| 2,988,242 | 6/1961 | Kneip | 220/24.3 |
| 3,068,442 | 12/1962 | Kubik et al. | 339/36 |
| 3,865,456 | 2/1975 | Dola | 339/40 |

*Primary Examiner*—Gil Weidenfeld
*Assistant Examiner*—Paula Austin
*Attorney, Agent, or Firm*—Maurice U. Cahn

[57] ABSTRACT

A child deterring electrical socket cover assembly adapted to cover an electrical socket, having a cover with at least one opening capable of exposing the socket, a complementary sliding door for covering or exposing the opening and a releasable locking means to permit the door to be moved into the exposed position upon release, is provided.

15 Claims, 7 Drawing Figures

ELECTRICAL SOCKET COVER

This invention relates to electrical socket covers and more particularly to an electrical socket cover having spring-bias closed plate guards and a double locking mechanism.

BACKGROUND OF THE INVENTION

Electric wall sockets to provide electricity for household and office electrical appliances are now ubiquitous in most structures. Most commonly, these sockets are located on a lower wall portion near the floor. As a result of such positioning these sockets are accessible to young children and therefore, often become the object of a curious child's attention. An unguarded socket outlet can prove very hazardous and even injurious to such children who are simply unaware of its danger. Many accidents and injuries have resulted from the menace created by the omnipresence of these sockets. Because the eternal curiosity of young children remains unabated, socket covers have been devised to deter surreptious or accidental contact of a child with electrical outlets.

Protective devices resulting from these efforts are illustrated in various patents. For example, Kubik in U.S. Pat. No. 3,068,442, illustrates a socket cover employing a compression spring-bias closed door guard. The sliding guard door is slidably engaged with and connected by two compression springs which are anchored to the main plate of the cover. To access the sockets, the guard is slid above the socket face for inserting an electrical plug.

Dola, U.S. Pat. No. 3,865,456, discloses a cover having two discrete spring-biased closed door guards which provides slots for the prongs of a plug. Inserting the plug prongs into the slots and moving the plug and therefor the guard to a position corresponding with the slots of one of the electrical outlets, will permit the plug to be fully inserted into the outlet.

U.S. Pat. No. 2,988,242 relates to a socket cover combining dual, oppositely disposed, spring-bias closed door guards. Each of the door guards has a knob and is slidable within the cover and so arranged that pushing the knob causes the corresponding door guard to slide within the cover to leave the underlying socket exposed.

Another guard, illustrated in U.S. Pat. No. 2,818,991, employs an articulated arm assembly and button actuating linkage which, when depressed, causes two hinged plates to swing open projecting from the front of the cover thereby leaving an outlet exposed.

As the above-listed patents indicate, one of the primary purposes of these covers is to deter access to the socket outlets by a child. The deterence generally involves covering or shielding the socket from direct access. However, the protection cannot amount to too great an inconvenience when the use of the outlet is desired. None of the patents illustrate a device which both covers the socket and incorporates a locking and release mechanism to provide a two-stage but not to inconvenient a hinderance to a determined child from surreptious access.

SUMMARY OF THE INVENTION

It is, therefore, an object of this invention to provide an electrical socket cover which covers electrical outlets and provides a means hindering unimpeded movement of the cover.

It is another object of this invention to provide an electrical socket cover incorporating slidable guards which are not overly inconvenient to move when use of an outlet is desired.

Still another object of this invention is to provide an electrical socket cover which not only covers otherwise exposed outlets, but also hinders the displacement of those covers.

Yet another object of this invention is to provide an electrical socket cover that includes a locking device to prevent uncoordinated movement of the cover.

These and other objects are satisfied by an electrical socket cover assembly adapted to attach to and cover an electrical socket with a cover plate having an aperture for exposing an electrical outlet, a door cover for covering the aperture and being slidably connected to the cover plate in a manner to provide a first aperture covering position and a second aperture exposing position. The assembly also includes a releasable locking device for locking the door in the aperture covering position but the locking means is capable of moving between a depressed and undepressed position where such movement, from a depressed to undepressed position allows the door to slide relative to the coverplate to the aperture exposing position.

In other words this invention provides an electrical socket cover plate having slidable guard doors corresponding to the underlying outlets and a detent or locking device incorporated with each of the doors which demands simultaneous or near simultaneous actuation as the door is moved in order to expose that underlying outlet. This unique dual locking concept furthers the fundamental purposes of electrical socket covers by providing a simple but elegant solution to the access deterence problem.

DETAILED DESCRIPTION OF THE INVENTION

Figure 1:
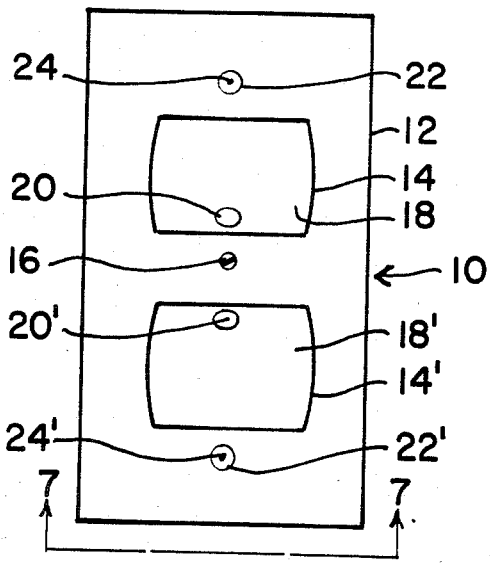
FIG. 1 is a front view of the invention.

In FIG. 1 is illustrated one preferred embodiment of this invention. When attached to a wall, only the outer surface of cover plate 10 is visible. The prominent features thereof include plate 12, generally constructed of a high impact resistant, rigid thermoplastic, and matching, oppositely disposed guard or shield doors 18 and 18′ generally composed of the same material. Face plate 12 includes two identical apertures 14 and 14′ so arranged and shaped as to correspond to the shape and size of conventional electrical wallsocket outlets. Hole 16 is centrally located on plate 12 and is adapted to accept a screw or other conventional attachment means dedicated to secure cover 10 to the socket.

In the closed position, as represented in FIG. 1, two guard doors 18 and 18′ cover apertures 14 and 14′, respectively, thereby preventing direct access to the underlying electrical outlets. Knob-like projections 20 and 20′ are disposed on doors 18 and 18′ to facilitate gripping and sliding the doors (as explained below) and also serve as lugs to limit the distance of movement of the doors. Buttonlike members 22 and 22′, further including projecting pinlike members 24 and 24′ project from plate 12. These members are disposed above and below doors 18 and 18′ respectively.

Figure 2:
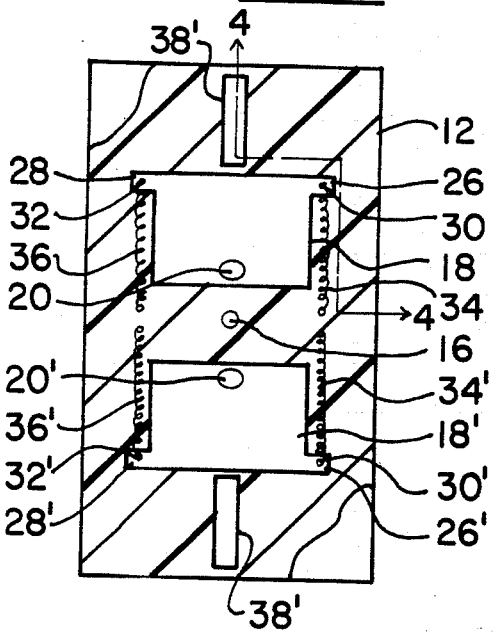
FIG. 2 is a cutaway front view of socket cover in accordance with this invention illustrating the back portion of the cover.

FIG. 2 better illustrates guard doors 18 and 18′ within the lower portion of a cutaway of plate 12. Guard doors 18 and 18′ are T-shaped and respectively have right side projecting arms 26 and 26′ and left side projecting arms 28 and 28′. Holes 30 and 30′ pass through right side projecting arms 26 and 26′ for attaching one end of compression springs 34 and 34′ respectively. Springs 34 and 34′ are anchored within Plate 12 by any appropriate means and arranged to tension doors 18 and 18′ in their closed or covered position. Left side projecting arms 28 and 28′ have holes 32 and 32′ respectively for attaching springs 36 and 36′ in the same fashion springs 34 and 34′ are attached to arms 26 and 26′ and plate 12.

Elongated depressible member 38 is affixed to the back of plate 12 at one end and engages edge 56 of door 18 at the other. Depressible member 38′ is arranged in the same manner relative to door 18′.

Figure 3:
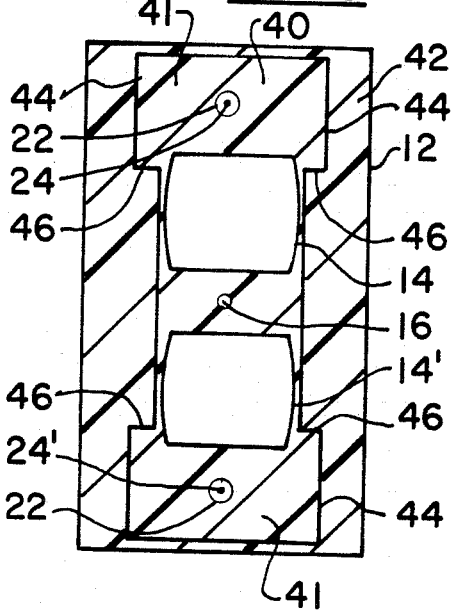
FIG. 3 is a cutaway view of a socket cover in accordance with this invention illustrating the back of the front portion of the cover.

FIG. 3 represents a view of the back side of plate 12 corresponding to the lower portion illustrated in FIG. 2. As noted, apertures 14 and 14′ are positioned to expose electrical outlets of a conventional wall socket and hole 16 is provided for a screw to attach plate 12 to the socket. I-shaped region 40 is shallower than surrounding region 42 and is adapted to have guard doors 18 and 18′ recessed therein. The difference in thickness between indented or shallower region 40 and raised region 42 is substantially equivalent to the thickness of door guards 18 and 18′. I-shaped region 40, as defined by ridges 44 and 46, provides a track in which doors 18 and 18′ may slide. Projecting arms 26, 26′, 28, 28′ of door 18 and 18′ extend across and are substantially the same width as the upper and lower, wider sections 41 of region 40. The length of wider sections 41 therefore confine and determine the distance which doors 18 and 18′ may slide. Centrally located in wide sections 41 of region 40 are the bottoms of buttons 22 and 22′ from which pin-like members 24 and 24′ project.

Figure 4:
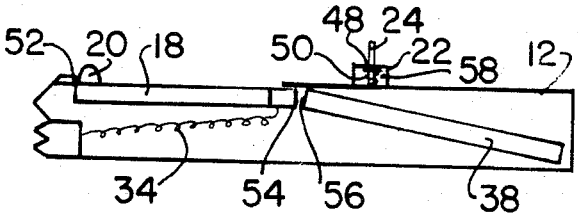
FIG. 4 is a cutaway side representation of exaggerated depth illustrating a socket cover in accordance with this invention as depicted in FIG. 1.
Figure 5:
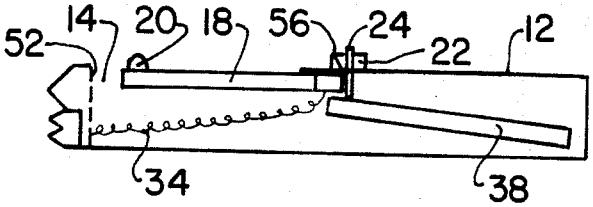
FIG. 5 is a cutaway side representation of exaggerated depth illustrating an intermediate position of a socket cover in accordance with this invention.
Figure 6:
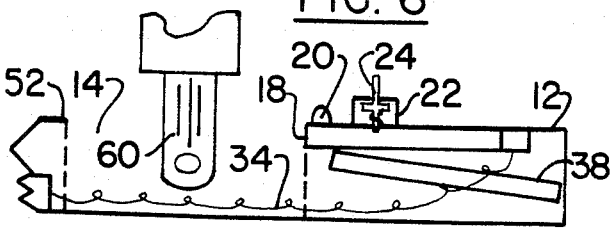
FIG. 6 is a cutaway side representation of exaggerated depth illustrating a socket cover in accordance with this invention in a position leaving the electrical outlet exposed.

FIGS. 4–6 illustrate the relationship of the various components of the preferred embodiment of the invention. In FIG. 4, door 18 covers aperture 14. Knob 20 abuts edge 52 of plate 12 and edge 54 of door 18 abuts or is in close proximity to edge 56 of depressible member 38. Door 18 is biased into this position by spring 34. Buttonlike member 22 includes cavity 58 through which pin-like member 24 projects. Pin-like member 24 is biased to project above button-like member 22 by compression spring 50 which is positioned between the bottom surface of flange 48 and the lower surface of cavity 58. Depressible member 38 slopes from the back and upper portion of plate 12 to abut edge 54 of door 18. Member 38 is either attached to the upper and back portion of plate 12 or is molded as a unitary member with plate 12.

In FIG. 5 door 18 is in an intermediate position. Pin-like member 24 is depressed so flange 48 abuts or nearly abuts the bottom of cavity 58. When depressing pin 24, the interior end thereof contacts depressible member 38 along its middle portion above edge 56 but below its point of attachment to plate 12. By this arrangement, pin-like member 24 depresses depressible member 38 thereby disengaging edge 56 from door edge 54. When pushed by knob 20, door 18 slides along the channel created by region 40 (see FIG. 3) until edge 54 abuts pin-like member 24. This movement results in exposing the lower portion of aperture 14.

FIG. 6 depicts the relative position of the various components when aperture 14 is fully exposed therefore allowing plug 60 to be inserted into the underlying socket. Upon release of button 24 when door 18 is in the intermediate position illustrated in FIG. 5, button 24 springs back into its biased, front projecting position and thereby disengages from edge 56. Disengaging pin 24 from edge 56 permits door 18 to slide within the channel provided by region 40 until edge 56 abuts the upper horizontal of region 41 (see FIG. 3) and knob 20 abuts the upper edge of aperture 14 in plate 12. As door 18 slides through the channel, depressible member 38 slides along the backside of door 18. When plug 60 is inserted into the underlying socket and the force on knob 20 is released, door 18 will snap back onto the upper plug surface to release the stretching forces on spring 34.

Figure 7:
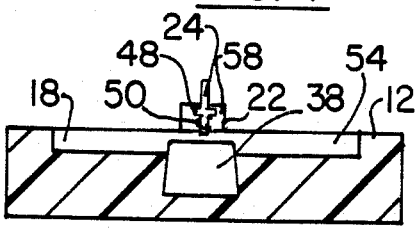
FIG. 7 is a cutaway top view of exaggerated depth illustrating a socket cover in accordance with this invention as depicted in FIG. 1.

FIG. 7 illustrates the comparative positions of the socket cover components as positioned in FIG. 1. Depressible member 38, attached to cover plate 12, rises to abut edge 54 of door guard 18. Button-like member 22 is positioned above the middle portion of depressible member 38. Pin-like member 24 projects from the top or front of button-like member 22 in a manner so that flange 48 abuts the front (top) wall of button-like member 22. Compression spring 50 is disposed between the bottom of flange 48 and the bottom wall forming cavity 58 to bias pin-like member 24 to project from the top of button-like member 22.

Alterations and modification of the preferred embodiment of this invention, as disclosed, will become apparent to those of ordinary skill in the art without departing from the scope or intent thereof as defined by the following claims.

What is claimed is:

1. An electrical socket cover assembly adapted to attach to and cover an electrical socket assembly of a type having at least one electrical outlet, comprising:

(a) a cover plate having at least one aperture there through adapted to expose the electrical outlet, (b) door means for covering said aperture, said door means being slidably connected to said cover plate and adapted to slide between at least a first aperture covering position, and a second aperture exposing position, and (c) releasable locking means for locking said door means into said first aperture covering position, said locking means capable of being moved between a first position and a second position where moving said locking means from said first position to said second position allows said door means to slide relative to said cover plate from said first aperture covering position to said second aperture exposing position.

2. A cover assembly according to claim 1 further comprising a depressible locking means for releasably engaging said door where said locking means is connected to said cover plate and disengages from said door thereby allowing said door to be moved.

3. A cover assembly according to claim 2 further comprising blocking means for preventing said door from being moved into said second aperture exposing position when said locking means is disengaged from said door, said blocking means capable of at least a first unblocking position and a second blocking position.

4. A cover assembly according to claim 3 further comprising said blocking means connected to said locking means in a manner where moving said blocking means to said second blocking position causes said locking member to disengage from said door, allowing said door to slide from said first aperture covering position until said door engages said blocking means and moving said blocking means to said first unblocking position allowing said door to slide to said second aperture exposing position.

5. A cover assembly according to claim 4 further including two apertures and two corresponding guard doors, said apertures and doors corresponding to underlying electrical socket outlets, spring members attached to each of said doors and said cover plate in a manner to bias said doors in said aperture covering positon.

6. An electrical socket and outlet assembly cover plate having an opening for exposing at least one electrical outlet and a shield having an upper edge and lower edge, the shield being connected to the cover plate and slidable relative to and along said plate to at least a first position where said outlet is exposed, said cover plate comprising:

(a) a depressible member at least partially disposed within said cover plate, said depressible member being positionable in a first undepressed position and a second depressed position, said depressible member having a base portion, an upper portion and a middle portion disposed therebetween, said upper portion being connected to said cover plate and said base portion abutting said upper shield edge when said depressible member is in said first undepressed position said shield is in said outlet covering position, and said base portion disengages from said upper shield edge when said depressible member is in said second depressed position, (b) means for depressing said depressible member said depressing means being connected to said cover plate wherein depressing said depressing means depresses said depressible member into said second depressed position thereby allowing said shield to slide into said first position where said outlet is exposed.

7. A cover plate according to claim 6 further comprising a button means projecting from said cover plate, said button means positionable between said first undepressed and said second depressed positions where said shield cannot be moved into said first position and where the outlet is exposed when said button means is in said second depressed position.

8. A cover plate according to claim 7 further comprising said button means engagable with said middle portion of said depressible member and with said upper shield edge.

9. A cover plate according to claim 8 further comprising channels in said cover plate in which said shield is slidably mounted.

10. A cover plate according to claim 9 further comprising at least one spring member, one end of said spring member being connected to the shield and the other end to said cover plate where said spring member biases said shield into said outlet exposing position.

11. A cover plate according to claim 10 further comprising a T-shaped shield having oppositely disposed arms, at least one spring member connected to each arm of the shield and said arms extending into and slidable within said cover plate channels.

12. A cover for attaching to the front of an electrical socket assembly of the type having dual electrical outlets with slots adapted for insertion of conventional electrical plugs, said cover comprising:

(a) a cover plate having a front and back and having a thickness relatively less than its length and width, said plate including two openings corresponding both in size and in position to expose said outlets, (b) guard means for covering said outlets, said guard means being slidably engaged with and contained within said cover plate and movable between a first outlet covering position and a second outlet exposing position, (c) guard releasing means secured to said cover plate and capable of movement between a first guard engaged position and a second guard disengaged position, and (d) depressible means for moving said guard releasing means between said guard engaging and disengaging positions, said depressible means attached to and projecting from said cover, where depressing said depressible member moves said guard releasing means into said disengaging position where said guard is then slidable within said cover to said outlet exposing position.

13. A cover according to claim 12 where said depressible member is movable between a first position and a second depressed position and is located on said cover relative to said guard so that depressing said depressible member into said second position will prevent said guard from being moved into said outlet exposing position, but upon returning to said first position, said guard may be moved into said outlet exposing position.

14. A cover according to claim 13 where said depressible means is a button-like member having a pin-like member projecting therefrom.

15. A cover according to claim 14 where said guard releasing means is an elongated member secured to the back of said cover plate.

* * * * *